US010669082B1

(12) United States Patent
Meshberg et al.

(10) Patent No.: US 10,669,082 B1
(45) Date of Patent: Jun. 2, 2020

(54) CHILD-RESISTANT DISK-TOP CLOSURE AND LOCKING SYSTEM FOR A CONTAINER

(71) Applicant: Packaging Concepts Associates Holding, Inc., Torrington, CT (US)

(72) Inventors: Emil Meshberg, Fairfield, CT (US); Ralph J. DeVito, Oxford, CT (US)

(73) Assignee: PACKAGING CONCEPTS ASSOCIATES HOLDING, INC., Torrington, CT (US)

( * ) Notice: Subject to any disclaimer, the term of this patent is extended or adjusted under 35 U.S.C. 154(b) by 0 days.

(21) Appl. No.: 16/443,176

(22) Filed: Jun. 17, 2019

(51) Int. Cl.

| | |
|---|---|
| ***B65D 55/02*** | (2006.01) |
| ***B65D 83/04*** | (2006.01) |
| ***B65D 43/16*** | (2006.01) |
| ***B65D 43/26*** | (2006.01) |

(52) U.S. Cl.
CPC ..... *B65D 55/022* (2013.01); *B65D 43/16* (2013.01); *B65D 43/26* (2013.01); *B65D 83/04* (2013.01); *B65D 2255/20* (2013.01)

(58) Field of Classification Search
CPC ..... B65D 55/022; B65D 47/08; B65D 50/06; B65D 50/065; B65D 50/066; B65D 50/067; B65D 50/068; B65D 83/04
See application file for complete search history.

(56) References Cited

U.S. PATENT DOCUMENTS

| | | | |
|---|---|---|---|
| 3,429,483 | A | 2/1969 | Micallef |
| 3,601,290 | A | 8/1971 | Nigro |
| 3,828,982 | A | 8/1974 | Steigerwald |
| 3,848,778 | A | 11/1974 | Meshberg |
| 4,024,988 | A | 5/1977 | Starrett |
| 4,773,567 | A | 9/1988 | Stoody |
| 4,838,460 | A | 6/1989 | Moore et al. |
| 5,224,615 | A | 7/1993 | Hickerson |
| 5,277,325 | A | 1/1994 | Yan |
| 5,279,451 | A | 1/1994 | Mueller et al. |
| 5,282,551 | A | 2/1994 | Pierson |
| 5,314,093 | A | 5/1994 | Gross et al. |

(Continued)

FOREIGN PATENT DOCUMENTS

| | | |
|---|---|---|
| EP | 2636610 A1 | 9/2013 |
| WO | 9429184 | 12/1994 |

(Continued)

OTHER PUBLICATIONS

Sonya Sing Lee, "Sprinkle Child resistant packaging," http://www.coroflot.com/sonyasinglee/sprinkle-child-resistant-packaging, Jun. 2, 2016.

(Continued)

*Primary Examiner* — Jeffrey R Allen
(74) *Attorney, Agent, or Firm* — Ware, Fressola, Maguire & Barber LLP

(57) ABSTRACT

A child resistant disk top closure system is provided that combines a disk top closure for a container with a child resistant locking mechanism system, which uses an automatic locking element that is depressed to enable a simultaneous rotation of a locking member to transition the disk top from a locked position preventing opening the disk top to dispense any substance in the container to an unlocked position, in which the disk top can be opened to enable dispensing of a substance in the container.

18 Claims, 13 Drawing Sheets

(56) References Cited

U.S. PATENT DOCUMENTS 5,379,924 A 1/1995 Taylor
5,379,926 A * 1/1995 Mueller ..... B65D 47/265 222/507
5,388,730 A 2/1995 Abbott et al.
5,431,293 A 7/1995 Piron
5,458,263 A 10/1995 Ciammitti et al.
5,462,183 A 10/1995 Rohr et al.
5,622,284 A 4/1997 Sawicki
5,628,627 A 5/1997 Fairbanks et al.
5,702,031 A 12/1997 Meshberg et al.
5,706,962 A 1/1998 Tauber
5,772,080 A 6/1998 de Pous et al.
5,979,681 A 11/1999 Varlet et al.
6,047,856 A 4/2000 Meshberg et al.
6,168,035 B1 1/2001 McLelland
6,283,333 B1 * 9/2001 Knickerbocker .. B65D 47/2006 222/153.14
6,691,896 B2 2/2004 Meshberg
6,896,160 B2 5/2005 Kaufman et al.
6,932,244 B2 8/2005 Meshberg
6,971,547 B2 12/2005 Englert et al.
7,168,594 B2 1/2007 Law et al.
7,434,707 B2 10/2008 Meshberg
7,530,476 B2 5/2009 Downey et al.
8,127,968 B2 3/2012 Yerby et al.
8,360,258 B2 1/2013 Gilbert et al.
8,777,061 B1 7/2014 Meshberg
9,045,265 B2 6/2015 Adamczak
10,167,120 B1 1/2019 Levy et al.
2002/0179644 A1 12/2002 Evans et al.
2004/0149787 A1 * 8/2004 Englert ..... B65D 47/2006 222/556
2007/0119870 A1 5/2007 Lasserre et al.
2018/0214894 A1 8/2018 Meshberg
2018/0221601 A1 8/2018 Meshberg
2018/0346210 A1 12/2018 Jelich

FOREIGN PATENT DOCUMENTS

WO 2006081928 A1 8/2006
WO 2018039175 A1 3/2018

OTHER PUBLICATIONS

Design Cognition, "New Child Resistant Spray Pack," http://www.designcognition.com/2010/07/new-child-resistant-spray-pack/, Oct. 21, 2010.
pharmapackagingdesign.com, "Package patent gallery," https://www.pharmapackagingdesign.com/pharmaceutical_package_patents.html, Oct. 23, 2014.
U.S. Appl. No. 16/446,084, "Child Resistant Flip-Top Closure and Locking System for a Container", filed Jun. 19, 2019.

* cited by examiner

SECTION A-A

SECTION B-B

SECTION C-C

SECTION E-E

SECTION F-F

SECTION G-G

CHILD-RESISTANT DISK-TOP CLOSURE AND LOCKING SYSTEM FOR A CONTAINER

FIELD OF THE INVENTION

The present application relates to child-resistant closure and locking device for containers, and in particular, a child-resistant disk-top closure and locking device for a container.

BACKGROUND OF THE INVENTION

A typical standard disk top closure is comprised of two parts, a body and a disk. The main body consists of a closure feature, such as threading or a snap for a container providing a single dispense orifice, which is disposed below the disk. The body provides the structure and disk pivot features, which hold the disk in position to either seal the container orifice, or to be pivoted to the dispense position, which allows the contained product to flow out of the orifice and pass through the disk and out of the dispense port. However, most disk-top closures do not include any child-resistant locking mechanism, or may include a locking mechanism that is overly complicated and too difficult for some elderly patients to open. What is needed is a child resistant closure and locking mechanism integrated a disk top that addresses these shortcomings in the art.

SUMMARY OF THE INVENTION

The present application provides for a disk top closure and locking system for a container that combines a disk top closure with a locking element that makes it difficult for a child to open the container, which uses an automatic locking element, and requires a rotation of parts from a dispense-disabled position, to a dispense-enabled position after unlocking the locking element.

In accordance with a first aspect of the application, a closure system for a dispensing container is provided. The closure system comprises a body member comprising: an upper surface comprising a standing axle extending therefrom, the standing axle comprising a hollow passageway; and an outer circumferential wall at a base of the upper surface comprising a standing edge extending from the outer circumferential wall and a recess formed in the outer circumferential wall adjacent to the standing edge. The closure system further comprises a rotating locking member comprising: a through-hole formed through the rotating locking member configured to receive the standing axle of the body member to secure the rotating locking member to the body member; and a cantilevered tab comprising a locking edge, which in a locked configuration, abuts a vertical edge defined by the recess of the body member configured to prevent rotation of the rotating locking member. The closure system further comprises a disk top secured to the rotating locking member and comprising: a dispensing orifice; and a protruding tab opposite the dispensing orifice configured to be depressed to pivot the disk top between an open configuration providing access to the dispensing orifice and a closed configuration concealing the dispensing orifice, wherein the protruding tab of the disk top abuts the standing edge of the body member in the locked configuration and the standing edge prevents depression of the protruding tab, wherein the cantilevered tab is configured to be flexed inwardly to dispose the locking edge within the outer circumferential wall of the body member and out of abutment with the vertical edge to enable the rotation of the rotating locking member and disk top secured thereto in a first axial direction to an unlocked configuration; and wherein in the unlocked configuration, the protruding tab is disposed over the recess and out of abutment with the standing edge of the body member to enable the depression of the protruding tab and pivoting of the disk top to the open configuration.

In accordance with an embodiment of the closure system of the first aspect of the application, the standing axle comprises a circumferential bead configured to engage the through-hole of the rotating locking member.

In accordance with a further embodiment of the closure system of the first aspect of the application, which may be in addition to or an alternative to any one or more of the above-identified embodiments of the closure system, the rotating locking member further comprises an inner wall comprising two opposing dimples configured to engage projecting members of the disk top to secure the disk top to the rotating locking member in a manner that permits the pivoting of the disk top and rotates the disk top with the rotating locking member.

In accordance with a further embodiment of the closure system of the first aspect of the application, which may be in addition to or an alternative to any one or more of the above-identified embodiments of the closure system, the rotating locking member further comprises a wall segment configured to seal the dispensing orifice in the closed configuration.

In accordance with a further embodiment of the closure system of the first aspect of the application, which may be in addition to or an alternative to any one or more of the above-identified embodiments of the closure system, the disk top further comprises a sealing member configured to engage the hollow passageway in the closed configuration to seal the hollow passageway from the dispensing orifice.

In accordance with a further embodiment of the closure system of the first aspect of the application, which may be in addition to or an alternative to any one or more of the above-identified embodiments of the closure system, the body member comprises an inner wall configured to be connected to the dispensing container.

In accordance with a further embodiment of the closure system of the first aspect of the application, which may be in addition to or an alternative to any one or more of the above-identified embodiments of the closure system, the rotating locking member and disk top are configured to be rotated axially about the standing axle approximately 30° between the locked configuration and the unlocked configuration.

In accordance with a further embodiment of the closure system of the first aspect of the application, which may be in addition to or an alternative to any one or more of the above-identified embodiments of the closure system, the rotating locking member and disk top are configured for rotation in a second axial direction opposite the first axial direction from the unlocked configuration to the locked configuration.

In accordance with a further embodiment of the closure system of the first aspect of the application, which may be in addition to or an alternative to any one or more of the above-identified embodiments of the closure system, the body member further comprises a plurality of stopping ribs, and the rotating locking member comprises an arcuate section defined by the locking edge of the cantilevered tab on a first end and a second edge on a second end, wherein during rotation of the rotating locking member in the first axial direction, the locking edge is configured to contact a first of the plurality of stopping ribs to prevent further rotation of the rotating locking member in the first axial direction, and wherein during rotation of the rotating locking member in the second axial direction, the second edge is configured to contact a second of the plurality of stopping ribs to prevent further rotation of the rotating locking member in the second axial direction.

In accordance with a further embodiment of the closure system of the first aspect of the application, which may be in addition to or an alternative to any one or more of the above-identified embodiments of the closure system, the body member further comprises a slot formed in the upper surface adjacent to the recess in the outer circumferential wall; and the rotating locking member comprises an arm having the cantilevered tab formed thereon configured to be received in the slot.

In accordance with a further embodiment of the closure system of the first aspect of the application, which may be in addition to or an alternative to any one or more of the above-identified embodiments of the closure system, the cantilevered tab is biased outwardly away from a center of the rotating locking member.

In accordance with a second aspect of the application, a dispensing container for a substance is provided, comprising a closure system. The closure system comprises a body member secured to the dispensing container comprising: an outer circumferential wall at a base of the upper surface comprising a standing edge extending from the outer circumferential wall and a recess formed in the outer circumferential wall adjacent to the standing edge. The closure system further comprises a rotating locking member secured to the body member, comprising: a cantilevered tab comprising a locking edge, which in a locked configuration, abuts a vertical edge defined by the recess of the body member configured to prevent rotation of the rotating locking member. The closure system further comprises a disk top secured to the rotating locking member and comprising: a dispensing orifice for dispensing the substance in the dispensing container; and a protruding tab configured to be depressed to pivot the disk top between an open configuration providing access to the dispensing orifice and a closed configuration concealing the dispensing orifice, wherein the protruding tab of the disk top abuts the standing edge of the body member in the locked configuration and the standing edge prevents depression of the protruding tab, wherein the cantilevered tab is configured to be flexed inwardly to dispose the locking edge within the outer circumferential wall of the body member and out of abutment with the vertical edge to enable the rotation of the rotating locking member and disk top secured thereto in a first axial direction to an unlocked configuration; and wherein in the unlocked configuration, the protruding tab is disposed over the recess and out of abutment with the standing edge of the body member to enable the depression of the protruding tab and pivoting of the disk top to the open configuration.

In accordance with an embodiment of the dispensing container of the second aspect of the application, the body member further comprises an upper surface comprising a standing axle extending therefrom, the standing axle comprising a hollow passageway in fluidic communication with an orifice through a neck of the dispensing container, and the rotating locking member further comprises a through-hole formed through the rotating locking member configured to receive the standing axle of the body member to secure the rotating locking member to the body member.

In accordance with a further embodiment of the dispensing container of the second aspect of the application, which may be in addition to or an alternative to one or more of the above-identified embodiments of the dispensing container, the disk top further comprises a sealing member configured to engage the hollow passageway of the body member in the closed configuration to seal the hollow passageway from the dispensing orifice; and in the open configuration, a continuous fluid passage is formed from the disk top dispensing orifice through the hollow passageway of the rotating locking member into the neck of the dispensing container to dispense the substance through the dispensing orifice.

In accordance with a further embodiment of the dispensing container of the second aspect of the application, which may be in addition to or an alternative to one or more of the above-identified embodiments of the dispensing container, the neck of the dispensing container comprises an external, circumferential bead and the body member comprises an inner wall comprising one or more locking elements configured to engage the circumferential bead on the neck to secure the closure system to the dispensing container.

In accordance with a further embodiment of the dispensing container of the second aspect of the application, which may be in addition to or an alternative to one or more of the above-identified embodiments of the dispensing container, the body member comprises an annular sealing member disposed beneath the upper surface that is configured to be received within the neck of the dispensing container.

In accordance with a further embodiment of the dispensing container of the second aspect of the application, which may be in addition to or an alternative to one or more of the above-identified embodiments of the dispensing container, the neck of the dispensing container is substantially cylindrical and comprises a central axis, and wherein the standing axle of the body member, the through-hole of the rotating locking member and the sealing member of the disk top are not centrally aligned with the central axis of the neck of the dispensing container.

In accordance with a third aspect of the present application, a closure system for a dispensing container is provided. The closure system comprises a body member comprising: an outer circumferential wall at a base of the upper surface comprising a standing edge extending from the outer circumferential wall and a recess formed in the outer circumferential wall adjacent to the standing edge. The closure system further comprises a rotating locking member secured to the body member, comprising: a cantilevered tab comprising a locking edge, which in a locked configuration, abuts a vertical edge defined by the recess of the body member configured to prevent rotation of the rotating locking member. The closure system further comprises a disk top secured to the rotating locking member and comprising: a dispensing orifice; and a protruding tab configured to be depressed to pivot the disk top between an open configuration providing access to the dispensing orifice and a closed configuration concealing the dispensing orifice; wherein the protruding tab of the disk top abuts the standing edge of the body member in the locked configuration and the standing edge prevents depression of the protruding tab; wherein the cantilevered tab is configured to be flexed inwardly to dispose the locking edge within the outer circumferential wall of the body member and out of abutment with the vertical edge to enable the rotation of the rotating locking member and disk top secured thereto in a first axial direction to an unlocked configuration; and wherein in the unlocked configuration, the protruding tab is disposed over the recess and out of abutment with the standing edge of the body member to enable the depression of the protruding tab and pivoting of the disk top to the open configuration.

DETAILED DESCRIPTION OF THE INVENTION

Figure 1C:
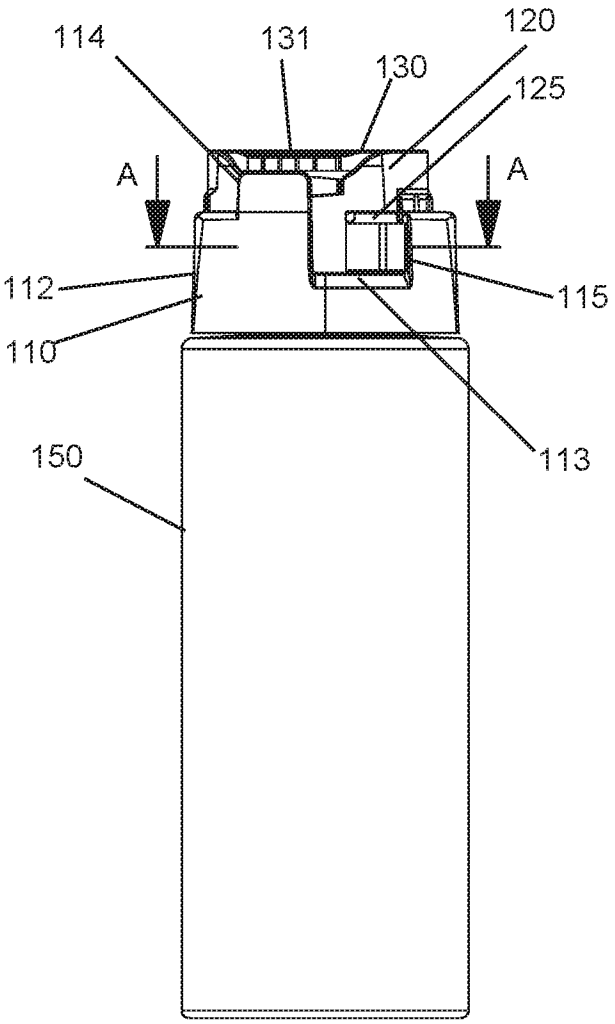
FIG. 1C shows a rear view of the dispensing container comprising the disk-top closure system in the locked configuration, in accordance with an embodiment of the present application.
Figure 1B:
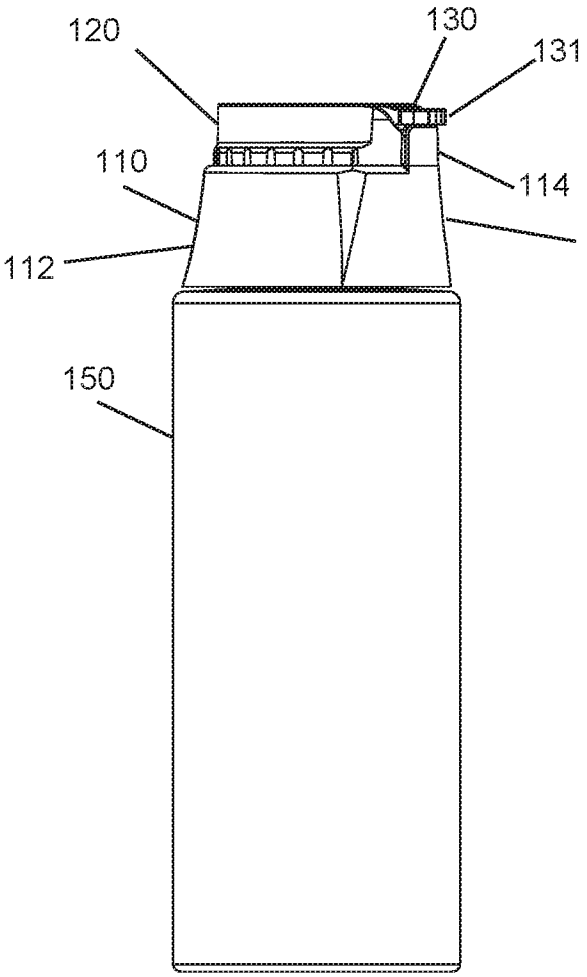
FIG. 1B shows a side view of the dispensing container comprising the disk-top closure system in the locked configuration, in accordance with an embodiment of the present application.
Figure 1A:
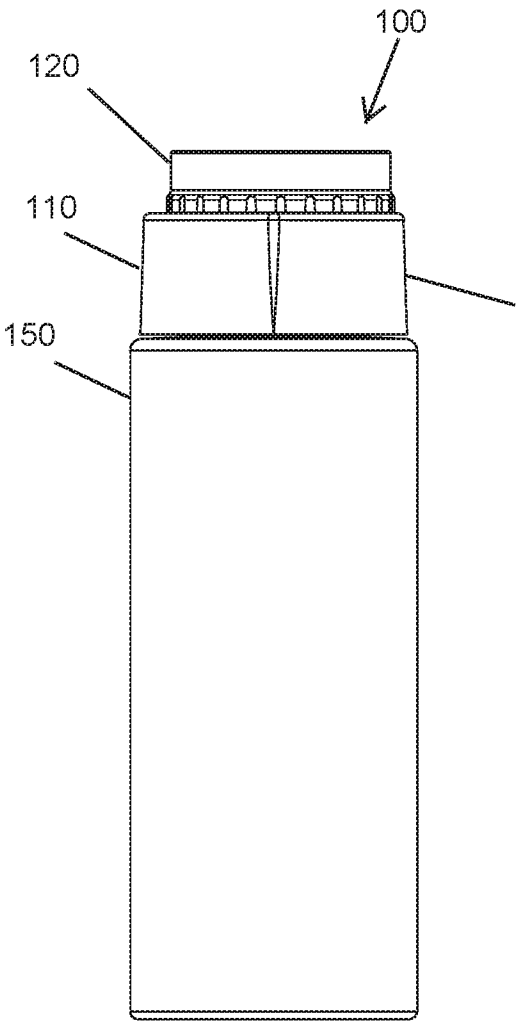
FIG. 1A shows a front view of a dispensing container comprising a disk-top closure system in a locked configuration, in accordance with an embodiment of the present application.
Figure 1E:
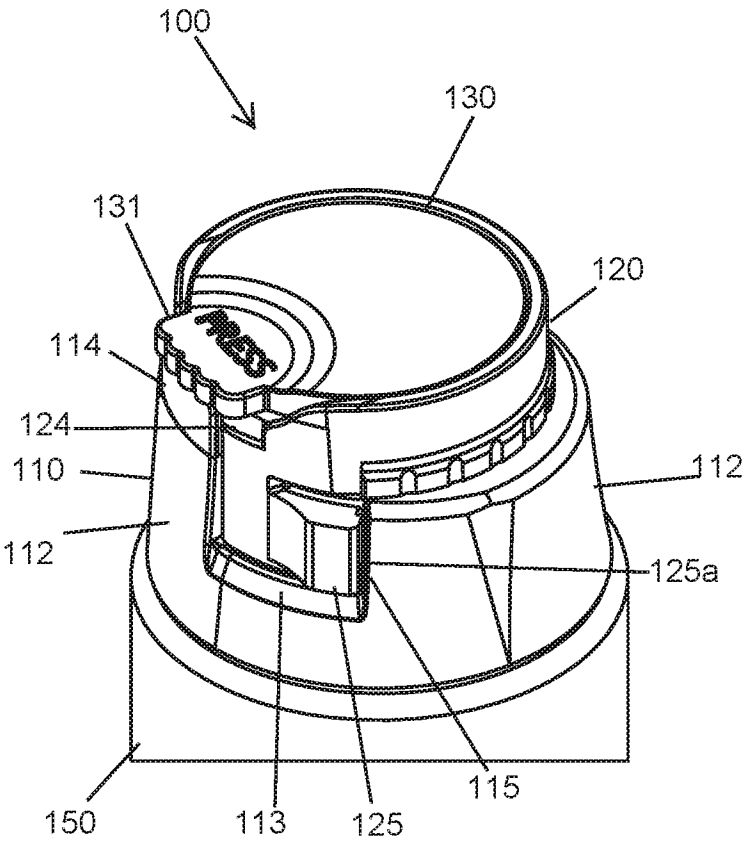
FIG. 1E shows a top perspective view of the dispensing container comprising the disk-top closure system in the locked configuration, in accordance with an embodiment of the present application.
Figure 1D:
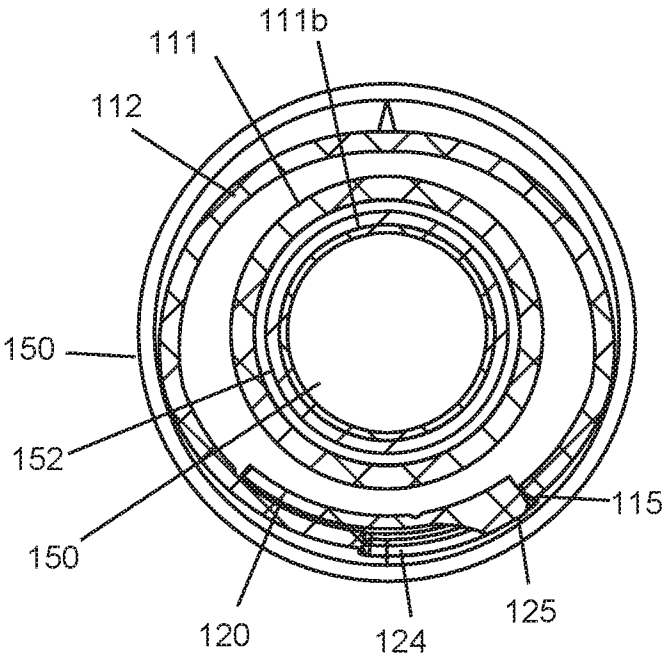
FIG. 1D shows a cross-sectional view of the dispensing container comprising the disk-top closure system in the locked configuration along axis A-A, in accordance with an embodiment of the present application.

The disk top closure system of the present application will be described with reference to FIGS. 1A-4D.

A child resistant ("CR") disk top closure system 100 in accordance with the present application combines a disk top closure for a container 150 with a CR system, which uses an automatic locking element and requires a rotation of parts from a dispense-disabled position, to a dispense-enabled position after unlocking. The CR disk top closure system 100 comprises a main body 110, a rotating locking member 120 and a pivotable disk 130.

The main body 110 acts as a means of attachment of the closure system 100 to the container 150 and comprises a single dispense orifice functioning as a standing axle 118 perpendicular to a plane. The main body 110 includes an inner wall section 111 that is dimensioned to fit over a dispensing orifice 151 of the container 150, and to engage a neck 152 of the container orifice 151. In the embodiment illustrated in the Figures, one or more locking elements 111*a* are arranged within the inner wall 111 that may snap over and engage a circumferential bead 153 on the neck 152 of the dispensing orifice 151. The main body 110 can be secured to the container 150 using alternative mechanisms that retain the "child-resistant" nature of the dispensing container, including for example with internal threading inside the inner wall 111 to engage a threaded dispensing orifice 151, which may further comprises locking teeth on the bottom of a screw thread that "lock" with corresponding teeth on the shoulder of the container 150, or floating teeth, wherein one must push down on the closure system 100 in order to engage the teeth on bottom of a screw thread with corresponding teeth on shoulder of container 150.

The main body 110 further includes an outer circumferential wall 112. The outer circumferential wall 112 includes a substantially U-shaped recess 113 cutout of the outer wall 112, which is defined on one end by a vertical edge 115 and on another, opposing end by a vertical portion 114*a* of an extended, standing edge 114. An upper surface 116 is disposed atop the outer circumferential wall 112. The upper surface 116 comprises a slot 117 formed therein, which receives an arm 126 extending from the locking member 120. The slot 117 is formed on the perimeter of the upper surface 116 adjacent to the standing edge 114 and the recess 113, such that when the arm 126 is disposed in the slot 117, the cantilevered tab 125 of the arm 126 can be exposed in the recess 113. The standing edge 114 extends from the outer circumferential wall 112 beyond the upper surface 116 of the main body 110.

A standing axle 118 is provided on the upper surface 116 of the main body 110, and defines a passageway 118*a* in fluidic communication with the dispensing port 151 of the container 150 when the main body 110 is affixed to the container 150. An annular seal 111*b* may also be provided on the reverse side of the upper surface 116 within the inner wall 111 and beneath the standing axle 118 that is dimensioned to be received within the neck 152 of the dispensing orifice 151 to provide a seal around the dispensing orifice 151. The standing axle 118 includes a protruding annular bead 118*b* about its circumference, which is configured to engage the locking member 120 to secure the main body 110 to the locking member 120 in such a manner that the locking member 120 can axially rotate about the main body 110, which is in a fixed position secured to the container 150.

The rotating locking member 120 includes the mechanical framework to support the pivotable disk 130. The locking member 120 comprises a through-hole 122 passing through a floor 121 of the locking member 120, which coincides with the protruding, standing axle 118 of the main body 110, so the locking member 120 can rotate about the standing axle 118 yet remain captive on the standing axle 118. A raised rim 122*a* is provided around the through-hole 122, which engages the circumferential bead 118*b* of the standing axle 118 to inhibit disassembly of the locking member 120 from the main body 110. An outer wall 123 extends from the floor 121 of the locking member 120 (i.e., away from the upper surface 116 of the main body 110), circumferentially around the locking member 120 with a clearance area 124 formed therein.

The locking member 120 also includes an integral locking feature, which includes a cantilevered tab 125 which can be depressed or flexed from the at-rest/locked state, to the unlocked state, which then allows the rotation of the locking member 120. The locking member 120 includes an arm 126 that extends from the outer wall 123, substantially below the clearance area 124 in the outer wall 123, and the cantilevered tab 125 is arranged at one end of the arm 126. An edge 125*a* of the cantilevered tab 125 is concentric and interferes with the vertical edge 115 in the recess 113 on the main body 110, at rest, such that the locking member 120 cannot rotate relative to the main body 110. Once the tab 125 is depressed and the two interfering edges (125*a*, 115) no longer interfere, the locking member 120 can be rotated relative to the main body 110.

The disk top 130 is dimensioned so as to be substantially housed within the outer wall 123 of the locking member 120. On one side of the disk top 130, a tab 131 is provided, which can be depressed into the clearance area 124 of the locking member 120 in order to pivot the disk top 130 from a closed position to an open position. In the open position, a dispensing orifice 132, opposite the tab 131, on the disk top 130 is raised above the outer wall 123 of the locking member 120 and is exposed, and in the closed position, the disk top dispensing orifice 132 is arranged within the outer wall 123 of the locking member 120. The under surface of the disk top 130 includes a plug 133 that seals the dispense orifice 151 of the container 150 in the closed position by closing the open end of the passage 118*a* through the standing axle 118 of the main body 110. The seal of the main body 110 dispense orifice 118 is maintained by the disk seal 133 when closed in any axial position because the sealing features are round and concentric to the fixed dispense orifice standing axle 118. The disk top 130 is secured to the locking member 120 by way of two round projecting members 134 on opposing sides of the disk top 130 that are received in two opposing dimples 128 on the locking member 120. The disk top 130 is connected to the locking member 120 in such a manner that disk top 130 can be rotated on its pivot axis between the open and closed positions, and the disk top 130 is axially keyed to the locking member 120, so as the locking member 120 rotates axially from the locked to unlocked position, the disk top 130 also rotates axially along with the locking member 120. The disk top 130 can be secured to the locking member 120 in alternative manners that still allow the disk top 130 to pivot within the locking member 120 and rotate simultaneously with the locking member 120, such as by including the projections on the locking member 120 and the openings or dimples on the disk top 130, or by including a rod or pin(s) extending from or through the disk top 130 that is/are received by the locking member 120, or vice versa.

Figure 1G:
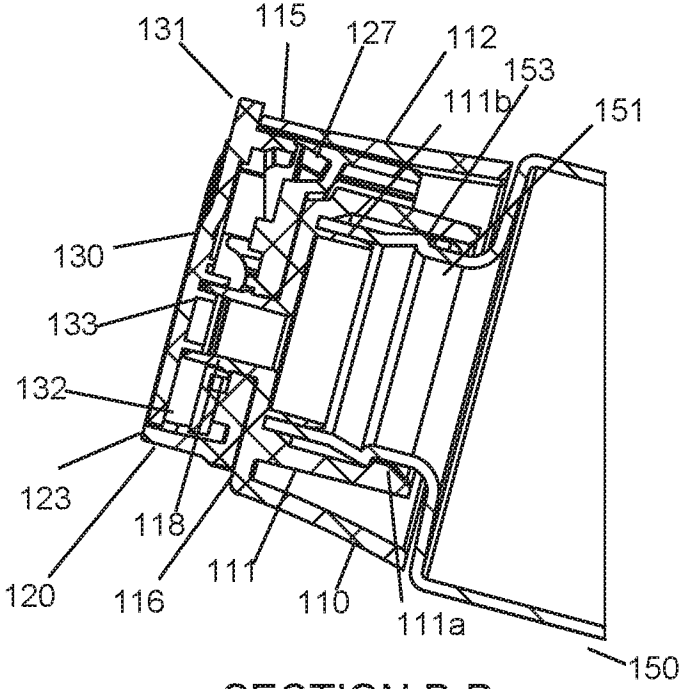
FIG. 1G shows a cross-sectional view of the dispensing container comprising the disk-top closure system in the locked configuration along axis B-B, in accordance with an embodiment of the present application.
Figure 1F:
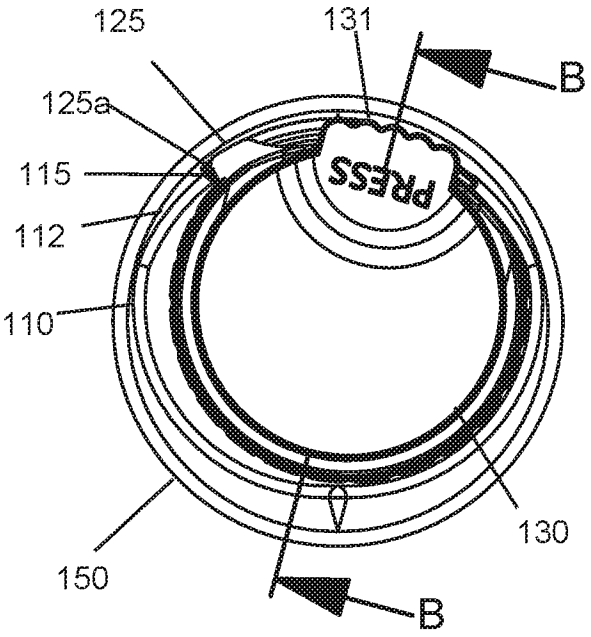
FIG. 1F shows a top view of the dispensing container comprising the disk-top closure system in the locked configuration, in accordance with an embodiment of the present application.
Figure 2C:
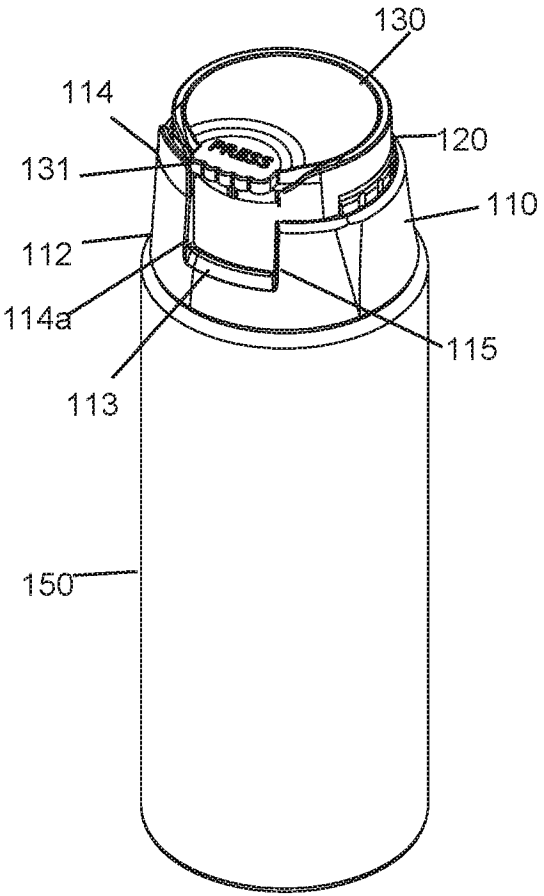
FIG. 2C shows a top, rear perspective view of the dispensing container comprising the disk-top closure system in the unlocked and closed configuration, in accordance with an embodiment of the present application.
Figure 2B:
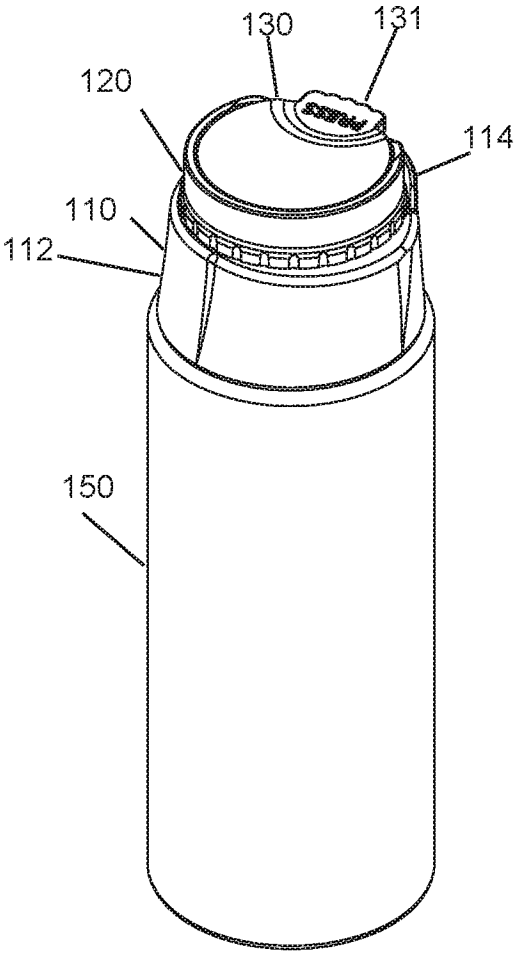
FIG. 2B shows a top, front perspective view of the dispensing container comprising the disk-top closure system in the unlocked and closed configuration, in accordance with an embodiment of the present application.
Figure 2A:
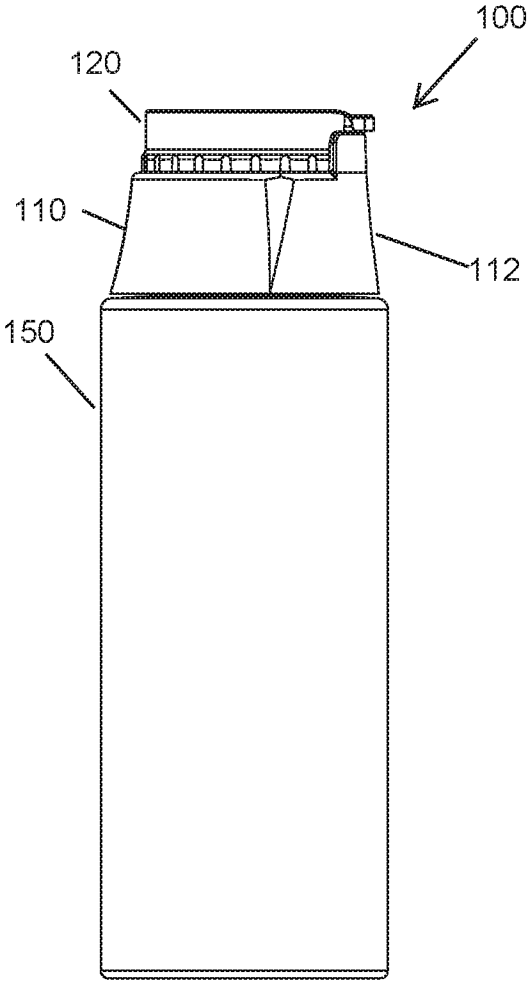
FIG. 2A shows a side view of the dispensing container comprising the disk-top closure system in an unlocked and closed configuration, in accordance with an embodiment of the present application.
Figure 2E:
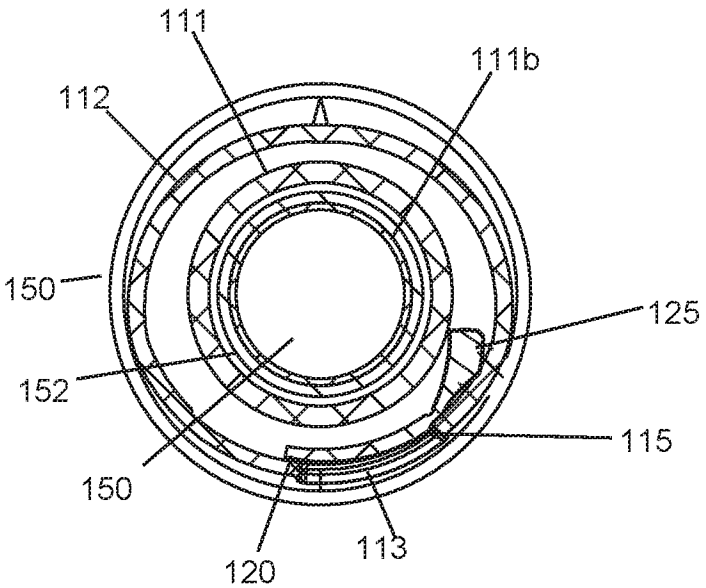
FIG. 2E shows a cross-sectional view of the dispensing container comprising the disk-top closure system in the unlocked and closed configuration along axis C-C, in accordance with an embodiment of the present application.
Figure 2D:
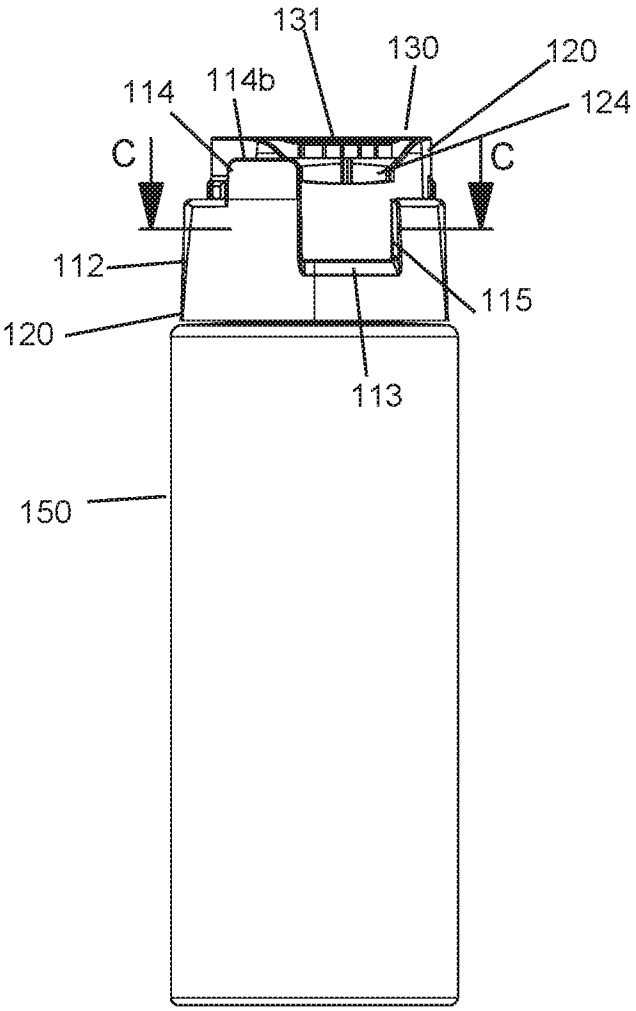
FIG. 2D shows a rear view of the dispensing container comprising the disk-top closure system in the unlocked and closed configuration, in accordance with an embodiment of the present application.
Figure 2F:
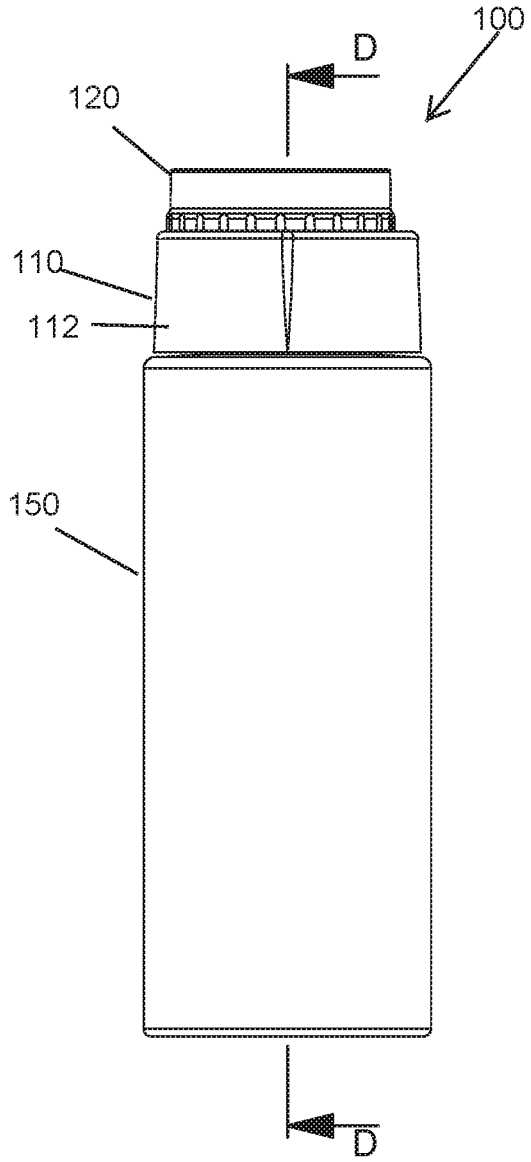
FIG. 2F shows a front view of the dispensing container comprising the disk-top closure system in the unlocked and closed configuration, in accordance with an embodiment of the present application.
Figure 2G:
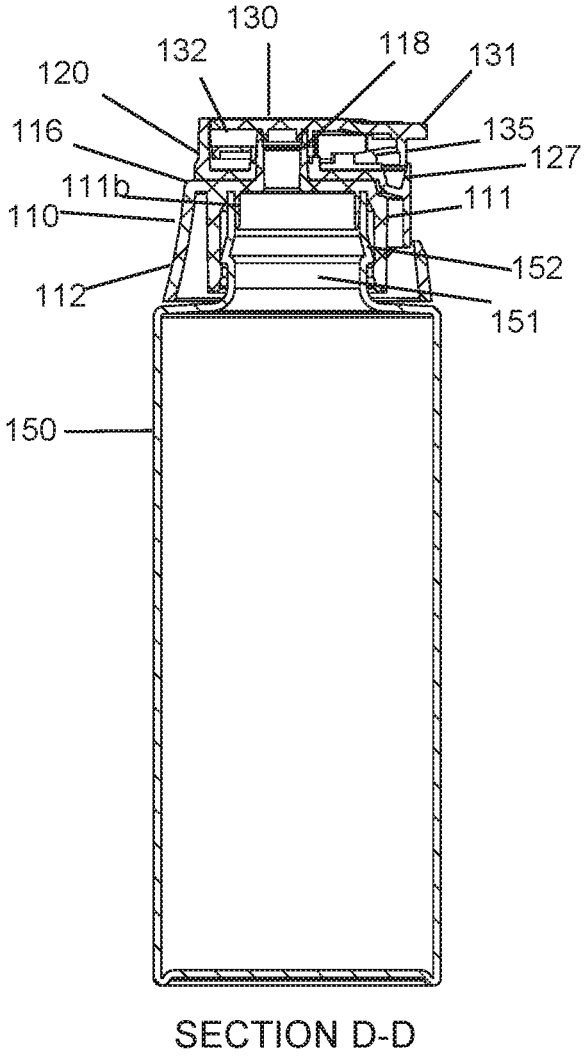
FIG. 2G shows a cross-sectional view of the dispensing container comprising the disk-top closure system in the unlocked and closed configuration along axis D-D, in accordance with an embodiment of the present application.
Figure 2I:
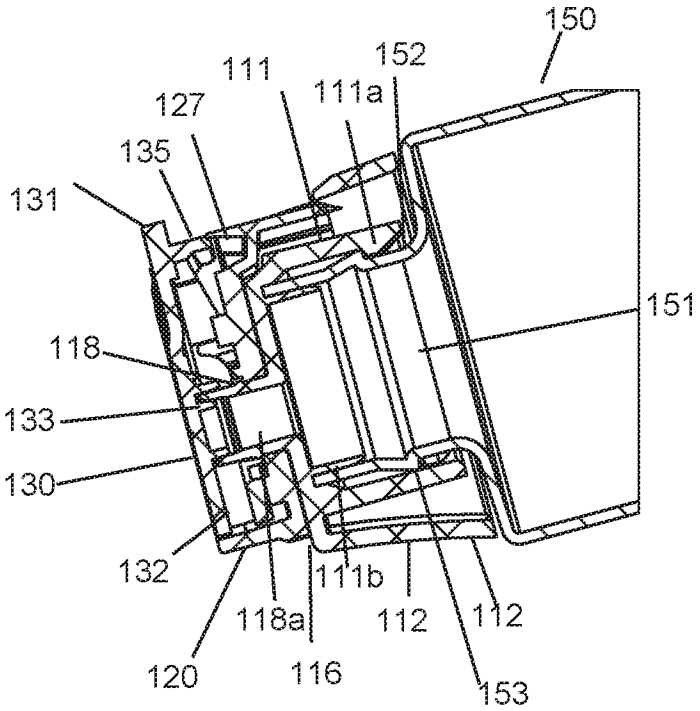
FIG. 2I shows a cross-sectional view of the dispensing container comprising the disk-top closure system in the unlocked and closed configuration along axis E-E, in accordance with an embodiment of the present application.
Figure 2H:
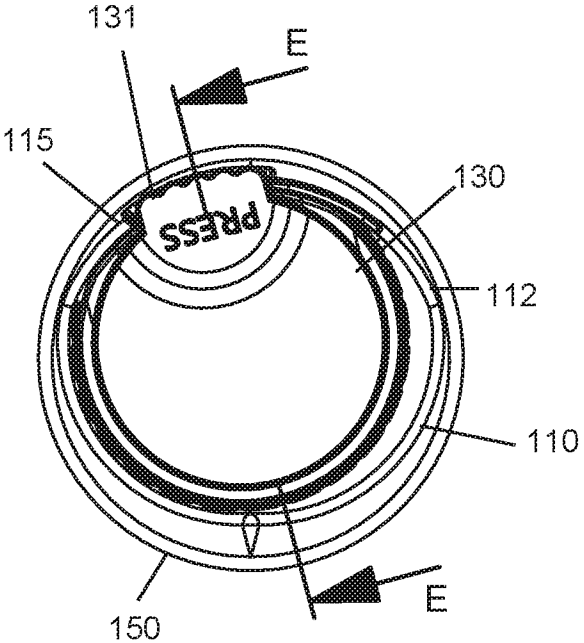
FIG. 2H shows a top view of the dispensing container comprising the disk-top closure system in the unlocked and closed configuration, in accordance with an embodiment of the present application.
Figure 3A:
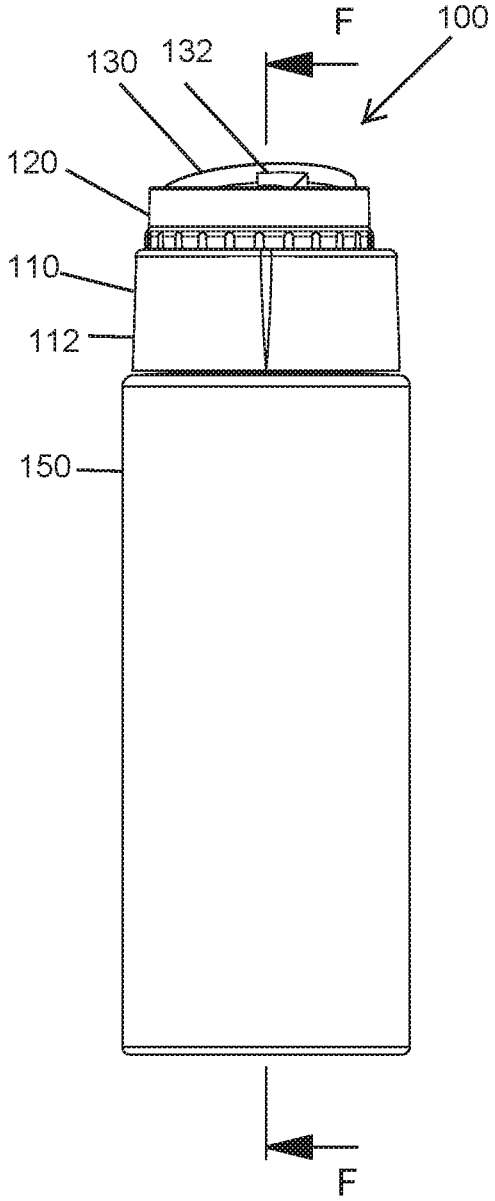
FIG. 3A shows a front view of the dispensing container comprising the disk-top closure system in an unlocked and open configuration, in accordance with an embodiment of the present application.
Figure 3B:
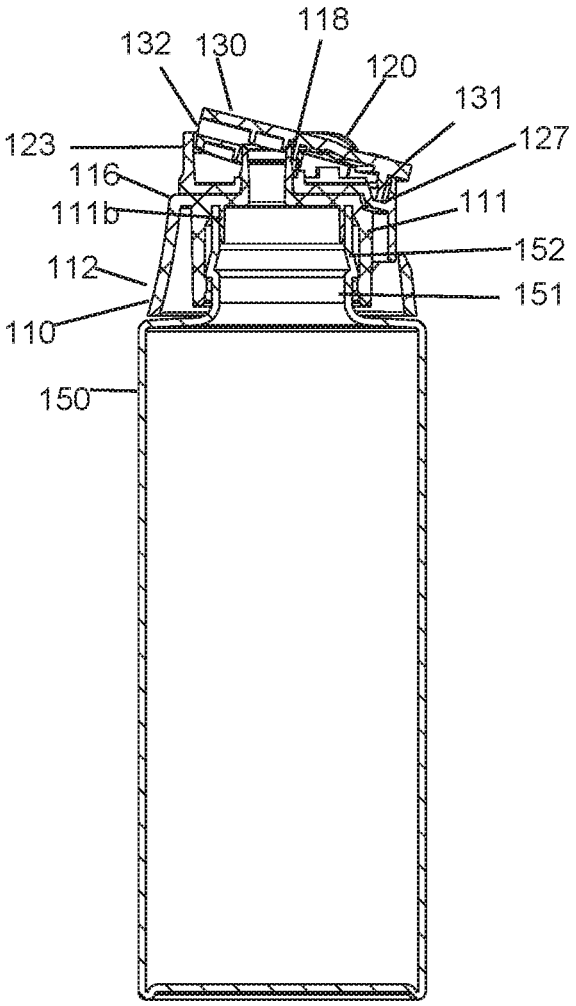
FIG. 3B shows a cross-sectional view of the dispensing container comprising the disk-top closure system in the unlocked and open configuration along axis F-F, in accordance with an embodiment of the present application.
Figure 3D:
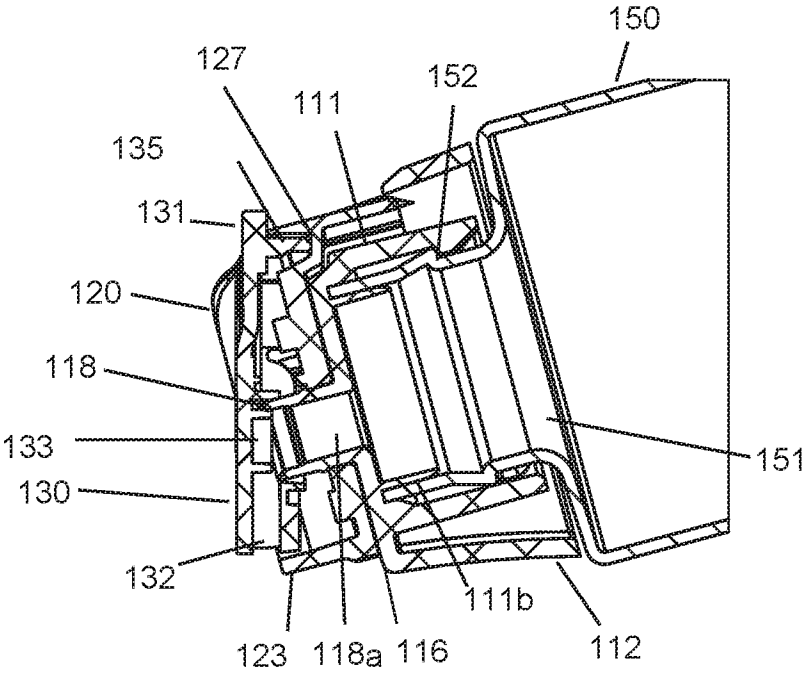
FIG. 3D shows a cross-sectional view of the dispensing container comprising the disk-top closure system in the unlocked and open configuration along axis G-G, in accordance with an embodiment of the present application.
Figure 3C:
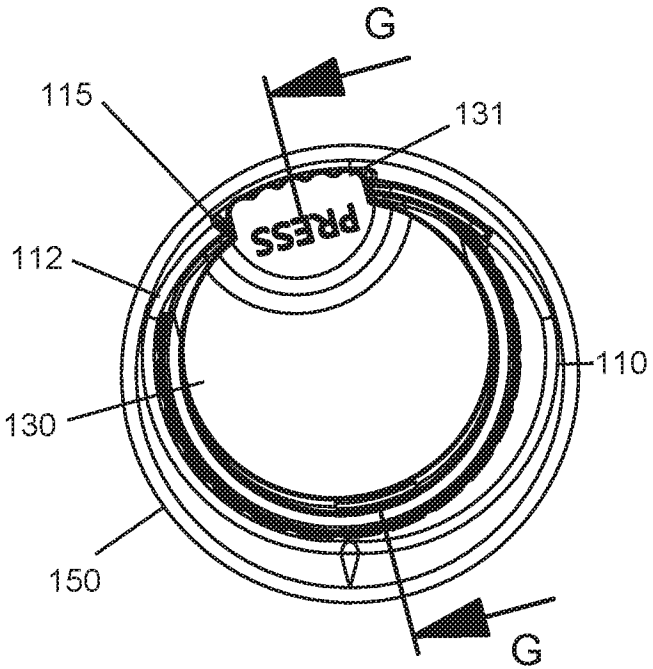
FIG. 3C shows a top view of the dispensing container comprising the disk-top closure system in the unlocked and open configuration, in accordance with an embodiment of the present application.
Figure 4A:
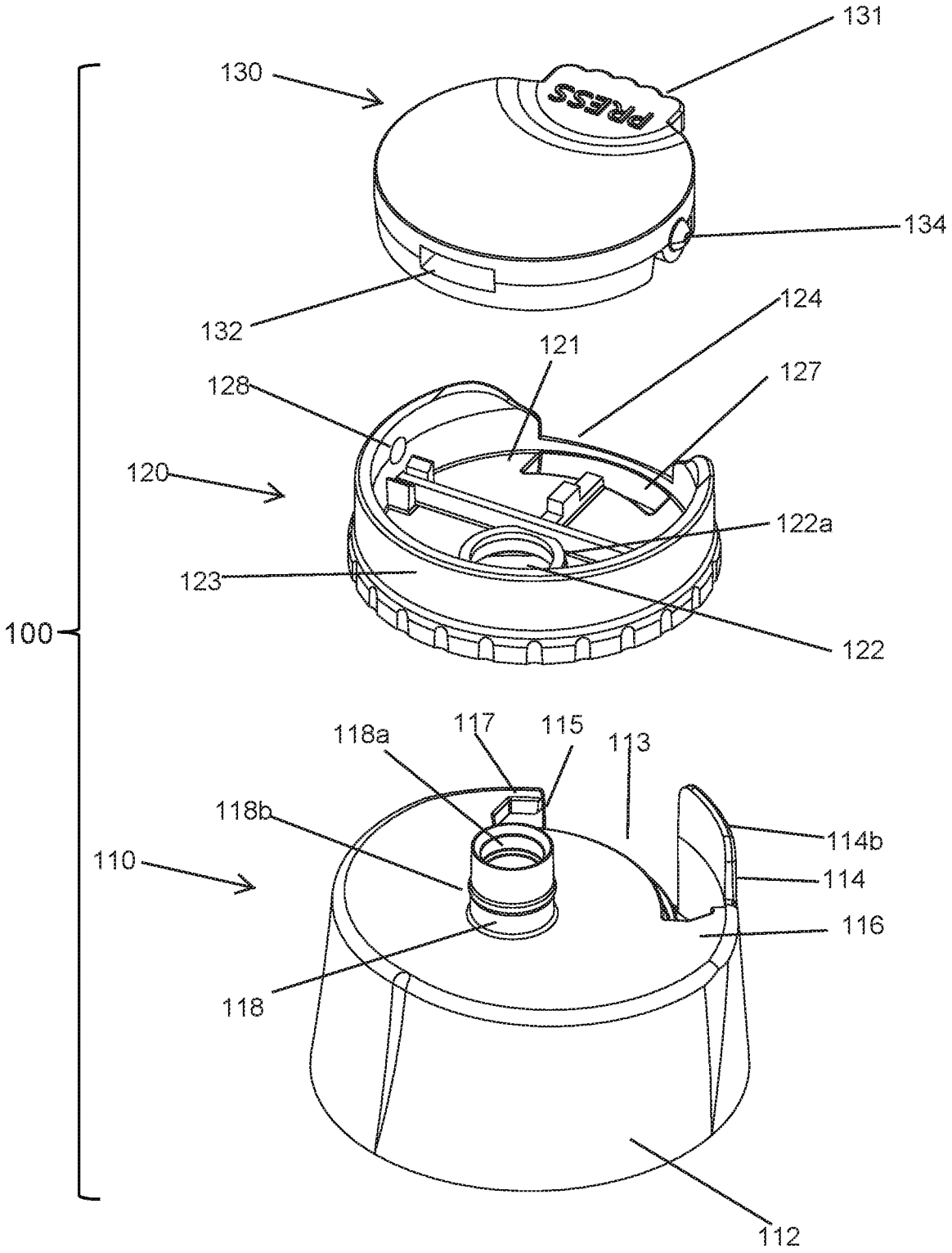
FIG. 4A-4D show exploded views of the disk-top closure system in accordance with an embodiment of the present application.
Figure 4B:
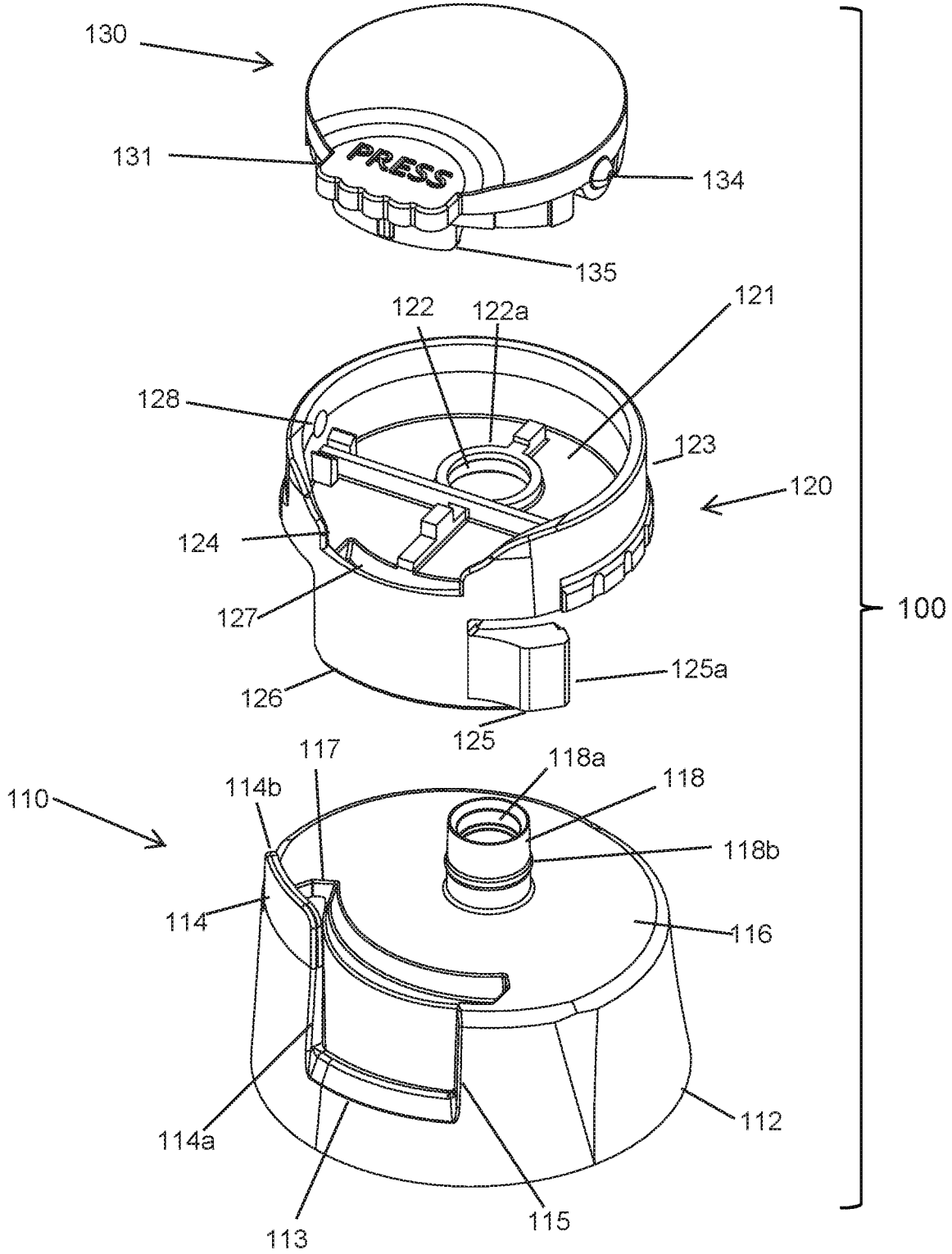
Figure 4C:
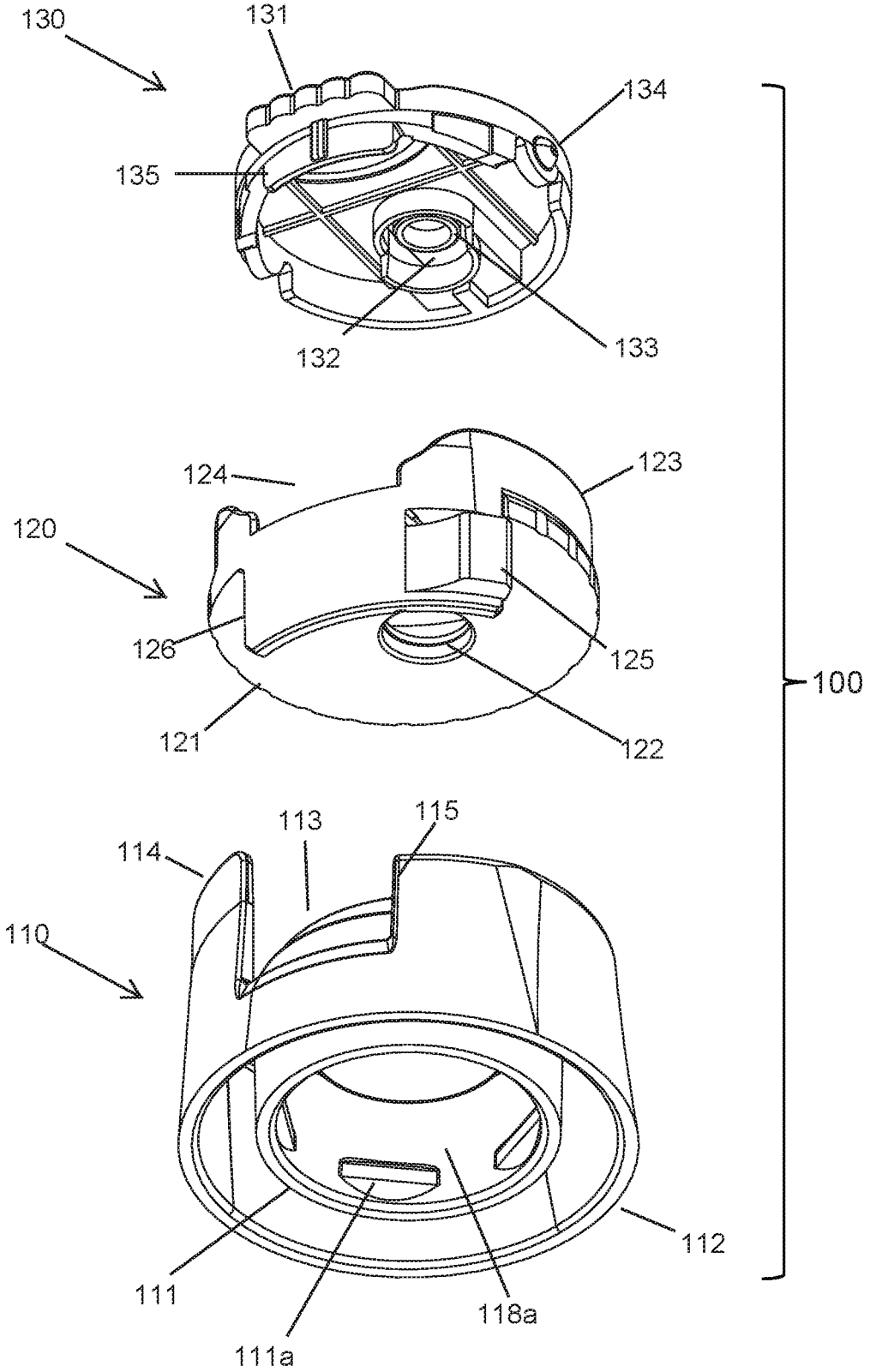
Figure 4D:
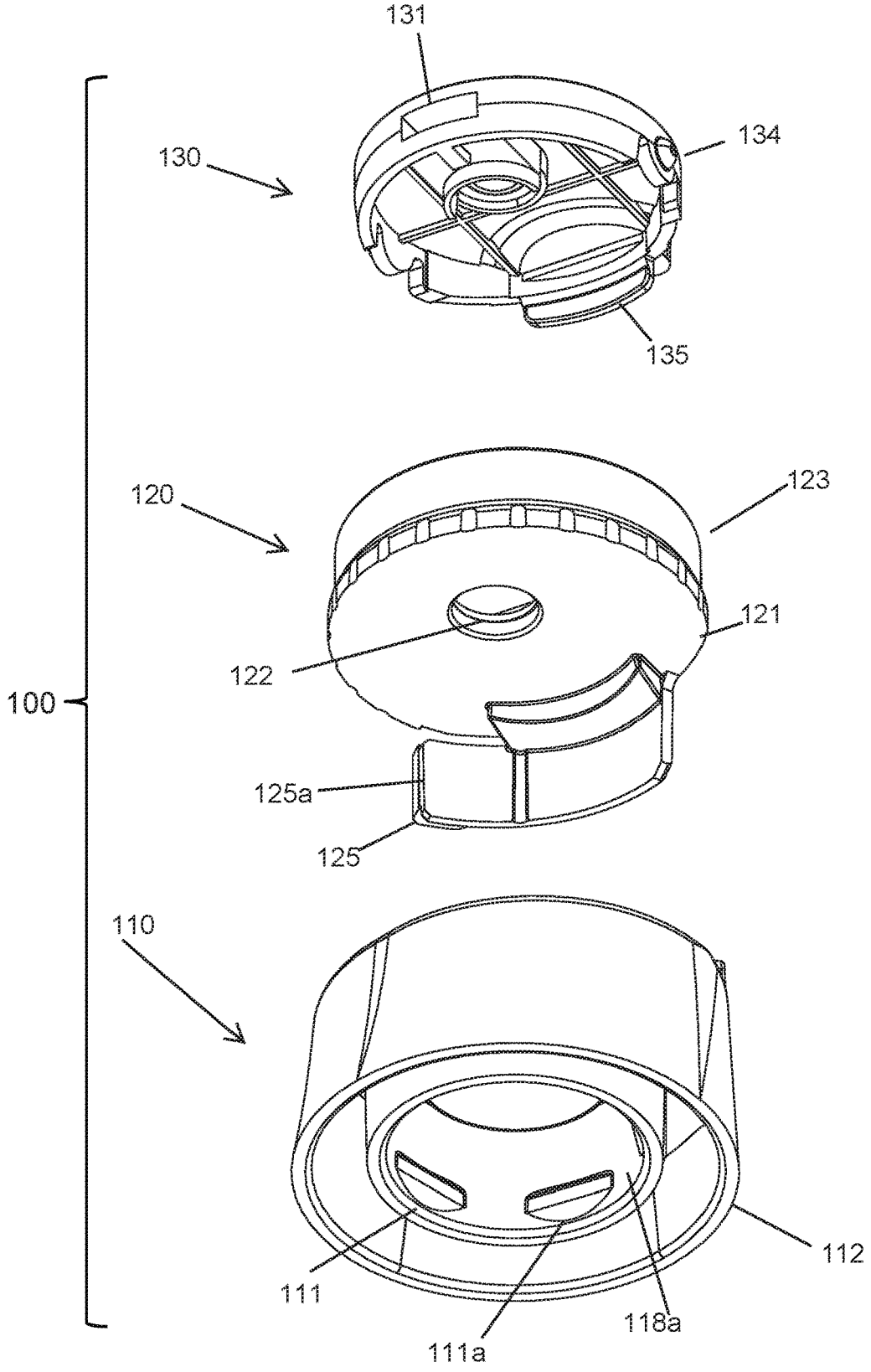

The dispensing container 150 may include a neck 152 or central opening through which the container substance can be dispensed out of the container 150. The neck 152 may have a cylindrical shape with a circular cross-section having a central axis formed therethrough. In the closed configuration (unlocked or locked), the standing axle 118 of the main body 110, the through-hole 122 of the locking member 120 and the sealing plug 133 are each in alignment. However, when secured to the dispensing container 150, these aligned elements of the closure system 100 are not aligned centrally with the central axis of the neck 152 of the dispensing container 150, that is, they are disposed off-center from the dispensing container 150 and rotate off of the central axis, as shown in FIGS. 1G and 2G, for example.

The protruding tab 131 of the disk top 130 comes to rest above a horizontal edge 114*b* the standing edge 114 of the main body 110 when the disk top closure system 100 is in a locked position, which impedes the pivot motion of the disk 130 from the closed/sealed position. Axial rotation of the locking member 120 and disk 130 from the locked to unlocked position causes the tab 131 to rotate away from the standing edge 114, so the disk 130 can be pivoted to the open/dispense angle.

The disk top closure system 100 includes the ability of the two-piece disk top functioning parts 120, 130 to rotate about a fixed axle dispense port 151 on a container 150, and to be automatically locked in a dispense disabled position, or rotated to a dispense enabled position after the cantilevered tab 125 is depressed. The inability of a small child to first depress the cantilevered tab 125, then rotate the locking member 120 to the open position contribute to the closure system 100 being "child-resistant."

FIGS. 1A-1G show various views of the disk-top closure system 100 and container 150 in the locked and closed configuration, disabling any dispensing of a substance in the container 150. In the locked configuration, the dispensing orifice 132 of the disk top 130 is disposed within the outer wall 123 of the locking member 120, thereby closing off the dispensing orifice 132. A plug 133 on an undersurface of the disk 130 is received by the standing axle 118 of the main body 110, thereby closing off the passageway 118*a* through the standing axle 118 into the container 150.

Further in the locked configuration, the protruding tab 131 of the disk 130 or a portion thereof, is disposed directly above and engages a horizontal edge 114*b* of the standing edge 114 projecting from the outer circumferential wall 112 the main body 110. The protruding tab 131 cannot be depressed in this configuration, such as to open the disk top 130 by pivoting the tab 131 downward and dispensing orifice 132 upward, as the standing edge 114 prevents such movement of the protruding tab 131 in the locked configuration. The disk top 130 is thus prevented from being opened to expose the dispensing orifice 132 and container orifice 151 in the locked configuration.

A cantilevered tab 125 of the rotating locking member 120 is disposed within a recess 113 of the outer circumferential wall 112 of the main body 110 when the closure system 100 is in the locked configuration. The recess 113 in the outer circumferential wall 112 can be substantially U-shaped, with the standing edge 114 on one side of the recess 113 and a vertical edge 115 on another side opposing a vertical portion 114*a* of the standing edge 114. At rest, the cantilevered tab 125 is biased outwardly (i.e., away from the center of the rotating locking member 120) and extends into the recess 113. An outwardly protruding edge 125*a* of the cantilevered tab 125 engages the vertical edge 115 of the recess 113. This engagement prevents the locking member 120 from being able to axially rotate in a direction that would disengage the protruding tab 131 of the disk 130 and the standing edge 114 and reposition the protruding tab 131 over the recess 113 of the outer circumferential wall 112 of the main body 110. The cantilevered tab 125 can be flexed inwardly by depressing the cantilevered tab 125 at or near the outwardly protruding edge 125*a*, which repositions the edge 125*a* within the outer circumferential wall 112 of the main body 110 and disengages the protruding edge 125*a* with the vertical edge 115. When the cantilevered tab 125 is disengaged from the vertical edge 115, the locking member 120 and connected disk top 130 can be rotated approximately 30 degrees from the locked configuration to the unlocked configuration. In order to unlock the disk-top closure system 100, the cantilevered tab 125 of the locking member 120 must be pressed and the locking member 120 rotated simultaneously.

In certain embodiments of the closure system 100, the main body 110 may comprise a pair of stopping ribs (not shown) arranged between the outer wall 112 and the inner wall 111, which are each configured to engage one of two vertical edges on the locking member 120, such as on the two ends of the arm 126. Each stopping rib is configured to engage a vertical edge when the locking member 120 is rotated in one of the two axial directions (i.e., in a first direction to unlock the closure system 100 and a second direction to relock the closure system 100), so that axial rotation of the flip-top member 120 relative to the closure body member 110 is constrained. FIGS. 2A-2I show various views of the disk-top closure system 100 and container 150 in the unlocked and closed configuration.

In the unlocked configuration, the locking member 120 and disk top 130 have been rotated from their position in the locked configuration, and the protruding tab 131 of the disk top 130 is disengaged from the standing edge 114 of the main body 110. The tab 131 of the disk 130 is repositioned to be entirely clear of the standing edge 114, and is disposed over the recess 113 in the outer circumferential wall 112 of the main body 110. The disk-top closure system 100 and the container 150 remain closed in this configuration and unable to dispense the contents of the container 150, but can be opened from this unlocked configuration. The protruding tab 131 of the disk 130 can be depressed to pivot the dispensing orifice 132 of the disk 130 vertically to expose the dispensing orifice 132.

FIGS. 3A-3D show various views of the disk-top closure system 100 and container 150 in the unlocked and open configuration.

When opened, the dispensing orifice 132 of the disk top 130 is exposed and the plug 133 of the disk top 130 is removed from the standing axle 118 of the main body 110. A continuous flow passage is formed from the container orifice 151, through the passageway 118*a* in the standing axle 118 and to the dispensing orifice 132 of the disk top 130 to allow dispensing the substance of the container 150.

The outer wall 123 of the locking member 120 comprises a clearance area 124 below the tab 131 of the disk top 130, so that the tab 131 can be depressed into the clearance area 124 without interference from the outer wall 123. The undersurface of the disk 130 includes an extension 135 that is positioned beneath the tab 131 and closes the clearance area 124 of the locking member outer wall 123 when the disk top 130 is closed, and prevents the formation of an open gap through the clearance area 124 in between the disk top 130 and the locking member 120. A depression 127 is formed in the floor 121 of the locking member 120 that is adjacent to the extension 135 of the disk 130 and is configured to receive the extension 135 when the disk top 130 is opened. The depression 127 is disposed in the slot 117 of the main body 110 when the locking member 120 is affixed to the main body 110.

To relock the disk-top closure system 100 and container 150, the disk top 130 can be closed by depressing the disk top 130 at or near the dispensing orifice 132, and the axial rotation of the locking member 120 and disk top 130 can be reversed to reposition the cantilevered tab 125 of the locking member 120 within the recess 113 of the main body 110. The cantilevered tab 125 is biased outwardly, such that when it is fully repositioned within the recess 113 of the main body 110, it extends back outwardly and the protruding edge 125*a* of the cantilevered tab 125 reengages the vertical edge 115 of the recess 113. This locking rotation repositions the tab 131 of the disk 130 over the standing edge 114 of the main body 110, at least in part, to prevent reopening of the disk top 130.

As used herein, directional or positional terms such as "front", "rear", "upper", "lower", "top", "bottom", etc., are used for explanatory purposes only to describe the closure system 100 having the orientation shown on the page for example in FIGS. 1A-1C and 2A-2D.

While there have been shown and described and pointed out fundamental novel features of the invention as applied to embodiments thereof, it will be understood that various omissions and substitutions and changes in the form and details of the devices and methods described may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice.

What is claimed:

1. A closure system for a dispensing container, comprising:

a body member comprising:

an upper surface comprising a standing axle extending therefrom, the standing axle comprising a hollow passageway; and an outer circumferential wall at a base of the upper surface comprising a standing edge extending from the outer circumferential wall and a recess formed in the outer circumferential wall adjacent to the standing edge;

a rotating locking member comprising:

a through-hole formed through the rotating locking member configured to receive the standing axle of the body member to secure the rotating locking member to the body member; and a cantilevered tab comprising a locking edge, which in a locked configuration, abuts a vertical edge defined by the recess of the body member configured to prevent rotation of the rotating locking member; and a disk top secured to the rotating locking member and comprising:

a dispensing orifice; and a protruding tab opposite the dispensing orifice configured to be depressed to pivot the disk top between an open configuration providing access to the dispensing orifice and a closed configuration concealing the dispensing orifice;

wherein the protruding tab of the disk top abuts the standing edge of the body member in the locked configuration and the standing edge prevents depression of the protruding tab;

wherein the cantilevered tab is configured to be flexed inwardly to dispose the locking edge within the outer circumferential wall of the body member and out of abutment with the vertical edge to enable the rotation of the rotating locking member and disk top secured thereto in a first axial direction to an unlocked configuration; and wherein in the unlocked configuration, the protruding tab is disposed over the recess and out of abutment with the standing edge of the body member to enable the depression of the protruding tab and pivoting of the disk top to the open configuration.

2. The closure system of claim 1, wherein the standing axle comprises a circumferential bead configured to engage the through-hole of the rotating locking member.

3. The closure system of claim 1, wherein the rotating locking member further comprises an inner wall comprising two opposing dimples configured to engage projecting members of the disk top to secure the disk top to the rotating locking member in a manner that permits the pivoting of the disk top and rotates the disk top with the rotating locking member.

4. The closure system of claim 1, wherein the rotating locking member further comprises a wall segment configured to seal the dispensing orifice in the closed configuration.

5. The closure system of claim 1, wherein the disk top further comprises a sealing member configured to engage the hollow passageway in the closed configuration to seal the hollow passageway from the dispensing orifice.

6. The closure system of claim 1, wherein the body member comprises an inner wall configured to be connected to the dispensing container.

7. The closure system of claim 1, wherein the rotating locking member and disk top are configured to be rotated axially about the standing axle approximately 30° between the locked configuration and the unlocked configuration.

8. The closure system of claim 1, wherein the rotating locking member and disk top are configured for rotation in a second axial direction opposite the first axial direction from the unlocked configuration to the locked configuration.

9. The closure system of claim 8, wherein the body member further comprises a plurality of stopping ribs, and wherein the rotating locking member comprises an arcuate section defined by the locking edge of the cantilevered tab on a first end and a second edge on a second end, wherein during rotation of the rotating locking member in the first axial direction, the locking edge is configured to contact a first of the plurality of stopping ribs to prevent further rotation of the rotating locking member in the first axial direction, and wherein during rotation of the rotating locking member in the second axial direction, the second edge is configured to contact a second of the plurality of stopping ribs to prevent further rotation of the rotating locking member in the second axial direction.

10. The closure system of claim 1, wherein the body member further comprises a slot formed in the upper surface adjacent to the recess in the outer circumferential wall; and wherein the rotating locking member comprises an arm having the cantilevered tab formed thereon configured to be received in the slot.

11. The closure system of claim 1, wherein the cantilevered tab is biased outwardly away from a center of the rotating locking member.

12. A dispensing container for a substance, comprising:

a closure system, comprising:

a body member secured to the dispensing container comprising:

an outer circumferential wall at a base of the upper surface comprising a standing edge extending from the outer circumferential wall and a recess formed in the outer circumferential wall adjacent to the standing edge;

a rotating locking member secured to the body member, comprising:

a cantilevered tab comprising a locking edge, which in a locked configuration, abuts a vertical edge defined by the recess of the body member configured to prevent rotation of the rotating locking member; and a disk top secured to the rotating locking member and comprising:

a dispensing orifice for dispensing the substance in the dispensing container; and a protruding tab configured to be depressed to pivot the disk top between an open configuration providing access to the dispensing orifice and a closed configuration concealing the dispensing orifice;

wherein the protruding tab of the disk top abuts the standing edge of the body member in the locked configuration and the standing edge prevents depression of the protruding tab;

wherein the cantilevered tab is configured to be flexed inwardly to dispose the locking edge within the outer circumferential wall of the body member and out of abutment with the vertical edge to enable the rotation of the rotating locking member and disk top secured thereto in a first axial direction to an unlocked configuration; and wherein in the unlocked configuration, the protruding tab is disposed over the recess and out of abutment with the standing edge of the body member to enable the depression of the protruding tab and pivoting of the disk top to the open configuration.

13. The dispensing container of claim 12, wherein the body member further comprises an upper surface comprising a standing axle extending therefrom, the standing axle comprising a hollow passageway in fluidic communication with an orifice through a neck of the dispensing container, and wherein the rotating locking member further comprises a through-hole formed through the rotating locking member configured to receive the standing axle of the body member to secure the rotating locking member to the body member.

14. The dispensing container of claim 13, wherein the disk top further comprises a sealing member configured to engage the hollow passageway of the body member in the closed configuration to seal the hollow passageway from the dispensing orifice; and wherein in the open configuration, a continuous fluid passage is formed from the disk top dispensing orifice through the hollow passageway of the rotating locking member into the neck of the dispensing container to dispense the substance through the dispensing orifice.

15. The dispensing container of claim 13, wherein the neck of the dispensing container comprises an external, circumferential bead and the body member comprises an inner wall comprising one or more locking elements configured to engage the circumferential bead on the neck to secure the closure system to the dispensing container.

16. The dispensing container of claim 13, wherein the body member comprises an annular sealing member disposed beneath the upper surface that is configured to be received within the neck of the dispensing container.

17. The dispensing container of claim 14, wherein the neck of the dispensing container is substantially cylindrical and comprises a central axis, and wherein the standing axle of the body member, the through-hole of the rotating locking member and the sealing member of the disk top are not centrally aligned with the central axis of the neck of the dispensing container.

18. A closure system for a dispensing container, comprising:

a body member comprising:

an outer circumferential wall at a base of the upper surface comprising a standing edge extending from the outer circumferential wall and a recess formed in the outer circumferential wall adjacent to the standing edge;

a rotating locking member secured to the body member, comprising:

a cantilevered tab comprising a locking edge, which in a locked configuration, abuts a vertical edge defined by the recess of the body member configured to prevent rotation of the rotating locking member; and a disk top secured to the rotating locking member and comprising:

a dispensing orifice; and a protruding tab configured to be depressed to pivot the disk top between an open configuration providing access to the dispensing orifice and a closed configuration concealing the dispensing orifice;

wherein the protruding tab of the disk top abuts the standing edge of the body member in the locked configuration and the standing edge prevents depression of the protruding tab;

wherein the cantilevered tab is configured to be flexed inwardly to dispose the locking edge within the outer circumferential wall of the body member and out of abutment with the vertical edge to enable the rotation of the rotating locking member and disk top secured thereto in a first axial direction to an unlocked configuration; and wherein in the unlocked configuration, the protruding tab is disposed over the recess and out of abutment with the standing edge of the body member to enable the depression of the protruding tab and pivoting of the disk top to the open configuration.

* * * * *